US006503580B1

(12) United States Patent
Ruffa

(10) Patent No.: US 6,503,580 B1
(45) Date of Patent: Jan. 7, 2003

(54) ACOUSTICALLY ENHANCED PAINT APPLICATION

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/917,591

(22) Filed: Jul. 30, 2001

(51) Int. Cl.[7] ..... B06B 1/00

(52) U.S. Cl. ..... 427/600; 204/450; 427/331; 427/385.5; 427/421; 427/428; 427/429; 427/560

(58) Field of Search ..... 427/560, 600, 427/421, 428, 429, 331, 385.5; 204/450

(56) References Cited

U.S. PATENT DOCUMENTS 3,676,216 A * 7/1972 Abitboul ..... 117/237
5,336,534 A * 8/1994 Nakajima et al. ..... 427/600

* cited by examiner

*Primary Examiner*—Bernard Painalto
(74) *Attorney, Agent, or Firm*—Michael J. McGowan; James M. Kasischke; Michael F. Oglo

(57) ABSTRACT

The present invention is a method of coating a substrate. First, a layer of liquid polymeric coating having a pigment and a solvent is applied to the substrate. An ultrasonic acoustic source is then provided and operated at a frequency of from about above 40 kHz to provide an acoustic pressure field and an it acoustic pressure of above 190 dB and directing the main lobe of the acoustic pressure field toward the layer of liquid polymeric coating. This acoustic pressure field reduces the gradient in and smoothes any uneven surface features in the liquid polymeric coating.

17 Claims, 2 Drawing Sheets

ACOUSTICALLY ENHANCED PAINT APPLICATION

STATEMENT OF GOVERNMENT INTEREST

The invention described herein may be manufactured and used by or for the Government of the United States of America for governmental purposes without the payment of any royalties thereon or therefor.

CROSS-REFERENCE TO OTHER PATENT APPLICATIONS

Not applicable.

BACKGROUND OF THE INVENTION (1) Field of the Invention

The present invention relates to coatings and more particularly to methods and apparatus for the application of coatings.

(2) Brief Description of the Prior Art

The prior art discloses a number of innovations related to the use of microwave, light and sound energy in improving painting or other coating processes.

U.S. Pat. No. 4,765,773 to Hopkins, for example, discloses a mobile paint application and microwave drying apparatus having a downwardly open hollow frame forming a microwave cavity movable over a surface on rollers. The interior cavity of the frame is coated with microwave absorbent material, as are the rollers. The frame in the front and rear conforms to the rollers with a certain gap and ends above the surface at a certain distance. Treads extend between the front and rear rollers on each side and have a thickness, which is greater than the gap and distance so as to create a circuitous path from the cavity which blocks microwave radiation. A paint spray nozzle is located in the cavity and applies paint to the surface. This paint is rapidly dried by a microwave generator, which is positioned in the cavity and directs radiation onto the wet paint.

U.S. Pat. No. 4,890,567 to Caduff discloses a robotically operated device using an ultrasonic transducer for the cleaning of a ship's hull. The device may also be used for spraying paints or other chemicals on the sides of the ship's hull. The device includes a housing having an open face adapted to confront the hull and apparatus disposed in the housing for impinging a flow of fluid through the open face onto the hull. An ultrasonic transducer is disposed in the housing for impinging a flow of ultrasonic energy through the open face onto the hull. Apparatus connected to the outside of the housing retains the housing on the ship's hull and moves the housing on the hull. In an additional embodiment, apparatus for spraying paint or other chemicals on a ship's hull is disposed in the housing.

U.S. Pat. No. 4,943,954 to Ostlie discloses a system and method for counteracting marine fouling of e.g., a vessel hull. Electro-mechanical vibration transducers are arranged in pairs adjacent to fixed nodal lines on the hull, and are driven in an inverted phase relationship in order to provide a water particle movement in a hull parallel direction right outside said nodal lines in addition to the hull perpendicular relative movements right outside said transducers. The invention also comprises a combination of the mechanical system above and a special surface coating which counteracts fouling from other organisms than those influenced by said water particle movement in the infra-frequency range.

U.S. Pat. No. 5,868,840 to Klein, II et al. discloses a spray gun for applying liquid spray coating, such as paint, to a surface incorporating a light source and detection system for analyzing the position of the spray gun relative to a work surface in order to optimize application of the coating to the surface. The light source is preferably in the form of a laser, which emits a beam of light toward the work surface. The laser is interconnected with the housing of the spray gun in a location over the spray gun handle so as not to effect the center of gravity of the spray gun. Optical sensors are reflected from the work surface, and the sensors are interconnected with a processor for providing the operator with a real time visual indication as to compliance with predetermined paint application criteria. In addition, information can be stored to memory and downloaded for subsequent analysis.

When spray painting an object, the paint will sometimes "drip" because it is applied to the surface unevenly. Paint may also tend to sag toward the bottom of a vertical substrate thus causing a thickness gradient in the paint layer.

A need, therefore, exists for an improved method of applying paint so as to avoid such features in the applied paint layer.

SUMMARY OF THE INVENTION

It is an object of the present invention to provide an economical and effective method for smoothing uneven features in the surface of the paint layer and reducing or eliminating thickness gradients in the paint layer.

This and other objects are met by the present invention, which is a method of coating a substrate. First, a liquid polymer based layer is applied to the substrate. Then, acoustic pressure is applied to the liquid polymer based layer to prevent irregular features and sag in the completed paint layer after drying.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts in the drawings and wherein.

DETAILED DESCRIPTION OF THE PREFERRED EMBODIMENT

Figure 1:
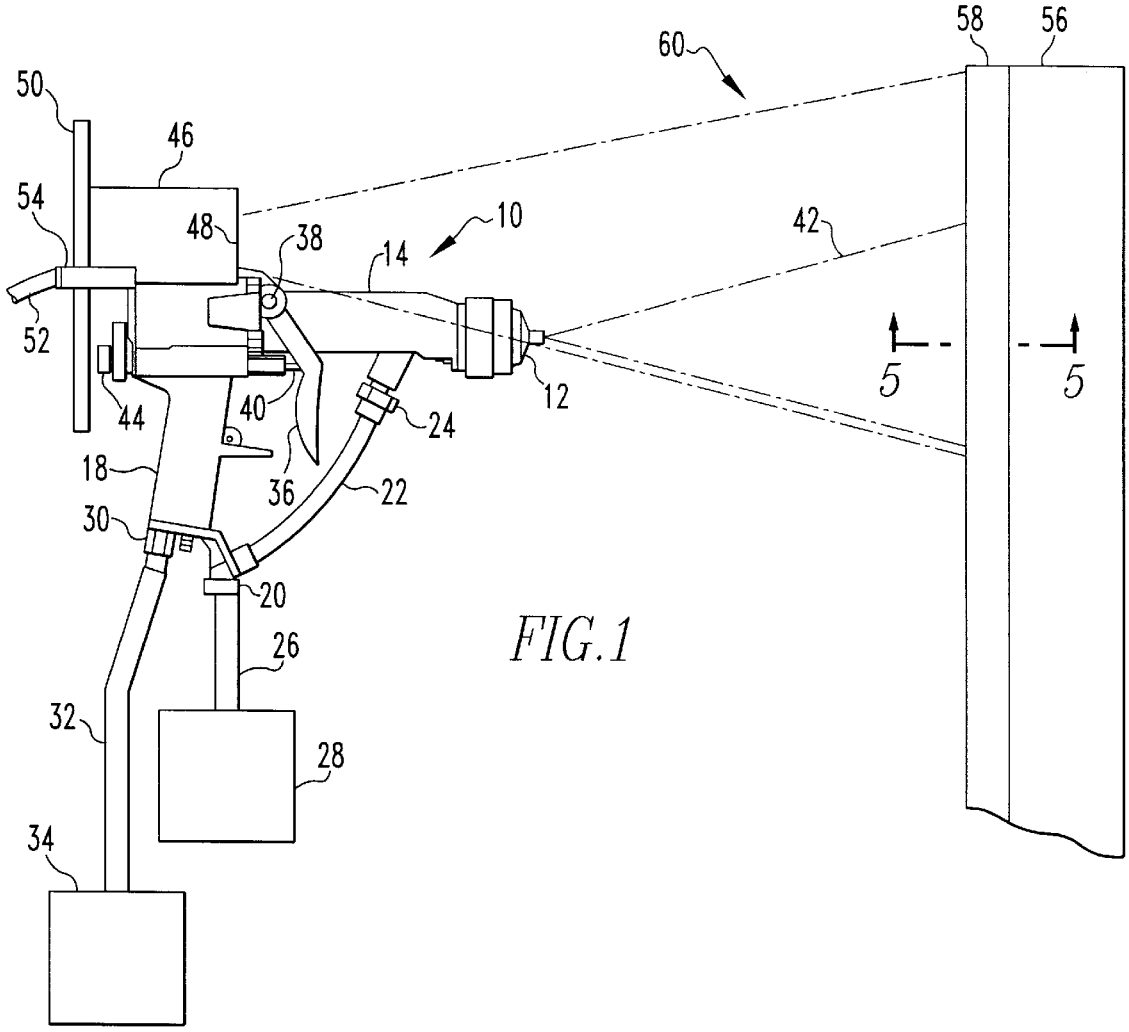
FIG. 1 is a schematic side elevational view of a paint spray gun and a vertical substrate with a liquid polymeric coating layer.

This invention consists of a high power, high frequency (e.g., ultrasonic) acoustic source that is close to or even attached to the spray gun or paint can. The resulting acoustic field-will act to quickly minimize the unevenness, or the gradient of the thickness of the paint layer.

Because of the frequencies used, there will be many pressure cycles compared to the time scales associated with both the uneven buildup of the paint layer and the downward flow of the paint due to gravitational forces. Thus, the paint will not have time to drip because of the thousands of pressure cycles that have already acted to minimize any thickness gradients.

The pressure field will be applied somewhat unevenly to the surface according to the beam pattern of the acoustic field. This is really not a concern for the following two reasons:

(1) The only significant variations in pressure over very small length scales will be due to nulls in the beam pattern. Here, surface tension in the fluid paint will act to minimize any differences in thickness due to this variation in pressure over these short length scales.

(2) The main lobe will in most cases be more than large enough to cover the region being sprayed. For example, if the frequency is 60 kHz, the main lobe will be approximately 30 degrees in width if the source array has a diameter of one inch.

In the transition from air to the liquid paint, the pressure of the acoustic field in the paint layer will be approximately double that in the air because the specific acoustic impedance of the air is negligible compared to that of the liquid paint. This reduces the sound pressure level needed by 6 dB. The actual sound pressure level will depend on the parameters of the paint e.g., viscosity, but an acoustic pressure level of 1/10 atmosphere or less should be more than sufficient. Taking into account the above 6 dB gain this translates into a localized sound pressure level of approximately 190 dB re 1 $\mu$Pa. This is easily achievable since the object will be in general very close to the source. The source can also be baffled so that the acoustic field will be blocked from propagating to the person painting. A baffle 5 inches in diameter is approximately 20 wavelengths in extent at 60 kHz. Such a baffle will effectively block substantially all of the acoustic energy from reaching the person painting.

Figure 2:
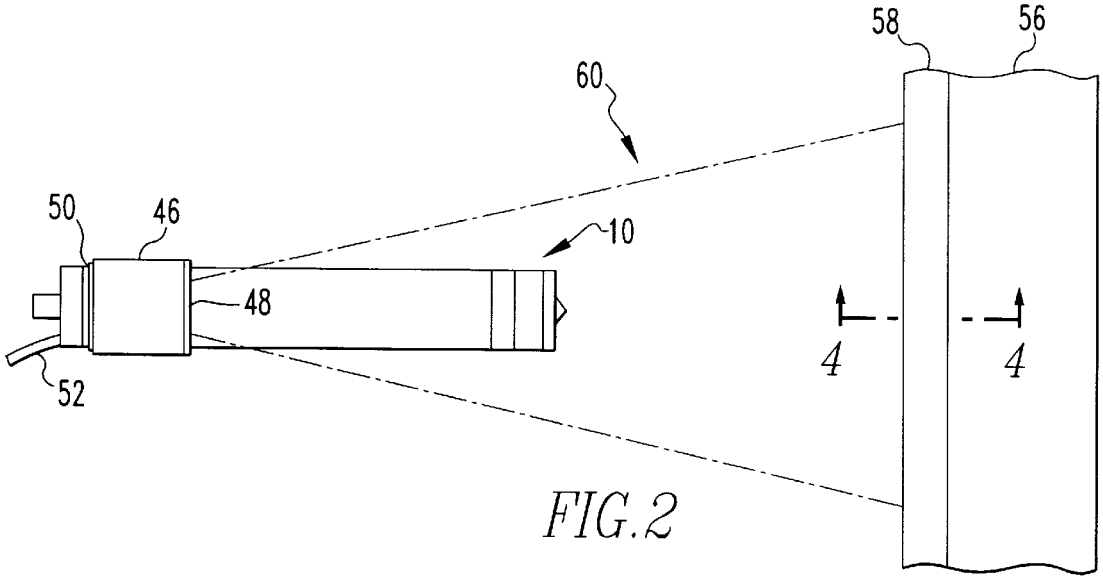
FIG. 2 is a top plan view of the paint spray gun and substrate shown in FIG. 1.

Referring to FIGS. 1 and 2, a spray gun 10 is shown. This spray gun is essentially conventional and includes a nozzle 12, a spray head section 14, a body section 16 and a handle 18. Adjacent handle 18 there is a paint supply fitting 20, which is connected by a paint tube 22 to another paint fitting 24 on spray head section 14. Also attached to paint supply fitting 24 is main paint supply line 26, which is connected to paint tank 28. There is also compressed air fitting 30 on handle 18, which connects to air line 32 that extends to compressed air tank 34. Spray gun 10 also includes trigger 36, which pivots on pin 38 to open or close air control valve 40 so that when air control valve 40 is opened to wider positions, more air flow will flow through spray gun 10 to apply more paint through paint tube 22 and fittings 20 and 24. As is conventional, paint will be sprayed in a generally conical pattern 42 through nozzle 12. On/off control 44 allows air and paint flow to be shut off while spray gun 10 is not in use. Mounted on top of body section 16 is a high powered ultrasonic acoustic source 46, which has a front acoustic array 48 and rear baffle 50 for shielding the operator (not shown) to the rear of spray gun 10. The direction of the source 46 can be tilted downward, if needed, so that the acoustic field is co-located with the paint spray. There is electrical cable 52, which is connected to the high power ultrasonic acoustic source 46 by electrical connector 54. Spray gun 10 is used to apply painting to vertical substrate 56. The paint applied in the generally conical pattern 42 and so a liquid polymer layer 58 is formed on vertical substrate 56. An acoustic pressure field 60 is produced by the high powered ultrasonic acoustic source 46 and is directed to the area on vertical substrate 56 on which the paint is being applied. The paint used in the method of this invention may be a polyolefin, polyester, polyurethane, epoxy resin based or include any other suitable resin. As is conventional, these paints will include one or more pigments and a suitable solvent. The paint will be applied in a layer of suitable thickness. In addition to being applied by spraying, the paint may also be applied by brush, roller, electro-deposition or by any other conventional way. The acoustic pressure adjacent the paint layer is preferably approximately 190 dB. The acoustic source is preferably operated at ultrasonic frequencies (e.g., greater than 20 kHz); however, the frequency could be lower. In various situations it may be preferred to maintain acoustic pressure on the applied paint until the paint dries to a solid firm. In other situations, depending on the viscosity of the paint, the nature of the substrate and ambient conditions, it may be possible to remove acoustic pressure before drying is complete.

Figure 3:
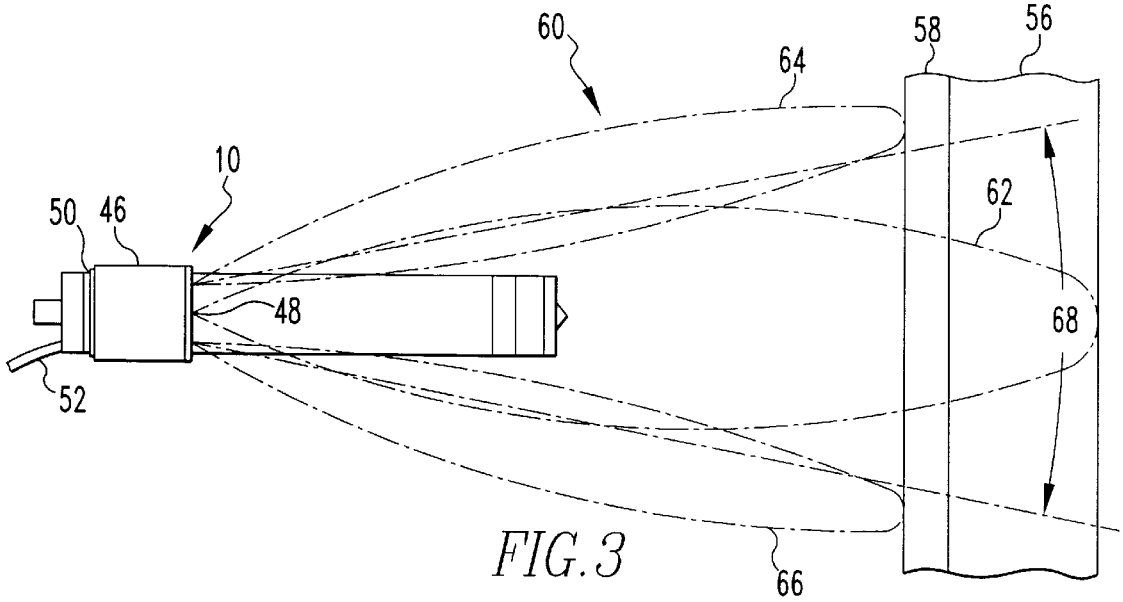
FIG. 3 is a top schematic view similar to FIG, 2 showing an acoustic pressure field.

Referring to FIG. 3, acoustic pressure field 60 shown in FIG. 2 is shown in detail to include main lobe 62 as well as lateral lobes 64 and 66. The angular width 68 of main lobe 62 is preferably a minimum of 10° to 20°.

Figure 4:
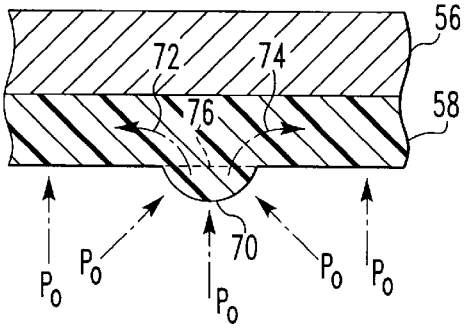
FIG. 4 is a detailed cross sectional view through 4—4 in FIG. 2.

Referring to FIG. 4, the enlarged horizontal cross section of a portion of liquid polymer layer 58 reveals an uneven feature 70, which may result from dripping of the paint. The application of acoustic pressure field $P_o$ results in paint flow 72 and 74 away from uneven feature 70 so as to substantially smooth out features smoothed surface 76 shown in phantom lines.

Figure 5:
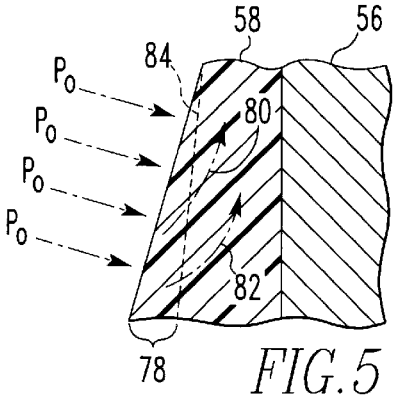
FIG. 5 is a detailed cross sectional view through 5—5 in FIG. 1.

Referring to FIG. 5, this enlarged vertical cross section of a portion of liquid polymer coating 58 has a thickness gradient 78. Because of acoustic pressure field $P_o$ generated by the high power ultrasonic acoustic source 46 paint flows 80 and 82 are established to reduce this gradient as to, for example, surface 84 as shown in phantom lines in FIG. 5.

It will be appreciated there has been described a method for applying paint or other coatings to a substrate so as to avoid any substantially uneven features on the surface of the applied paint or other coating layer or any thickness gradient in such layer.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of coating a substrate comprising the steps of:

applying a liquid polymeric layer to an area of the substrate; and directing a main lobe of an acoustic pressure field to impinge on said liquid polymeric layer applied to said area, said step of directing being carried out from a position that causes said main lobe to be substantially perpendicular to said liquid polymeric layer applied to said area, said step of directing being carried out simultaneously with said step of applying.

2. The method of claim 1 wherein the liquid polymeric layer has a thickness and said thickness has a gradient and said acoustic pressure field is sufficient to reduce said gradient.

3. The method of claim 1 wherein the liquid polymeric layer has a surface and said surface is uneven and said acoustic pressure field is sufficient to smooth said uneven surface.

4. The method of claim 1 wherein the liquid polymeric layer is sprayed on the substrate.

5. The method of claim 1 wherein the polymeric layer is applied by a brush, a roller or by electrodeposition.

6. The method of claim 1 wherein the liquid polymeric layer includes a pigment and a solvent.

7. The method of claim 1 wherein the liquid polymeric layer is comprised of a polymer selected from the group consisting of polyolefins, polyesters, polyurethanes and epoxies.

8. The method of claim 1 wherein said acoustic pressure field results from an acoustic source.

9. The method of claim 8 wherein the acoustic source is operated at a frequency of about 60 kHz.

10. The method of claim 8 wherein the acoustic source is an ultrasonic acoustic source.

11. The method of claim 1 wherein said acoustic pressure field adjacent the liquid polymeric layer is approximately 190 dB.

12. The method of claim 1 wherein said acoustic pressure field is directed toward the liquid polymeric layer until the liquid polymeric layer is dried to a solid polymeric film.

13. The method of claim 1 wherein the main lobe has a width from 10° to 20°.

14. The method of claim 1 wherein the substrate is vertically positioned.

15. A method of coating a substrate comprising the steps of:

spraying a liquid polymeric layer, comprising a polymer selected from the group consisting of polyolefins, polyurethanes and epoxies and a pigment and a solvent, onto an area of the substrate from a position that is spaced apart from the substrate, wherein said liquid polymeric layer has a thickness and said thickness has a gradient, and said liquid polymeric layer has an uneven surface;

providing an ultrasonic acoustic source approximately aligned with said position;

operating, simultaneously with said step of applying, said ultrasonic acoustic source at a frequency above 20 kHz to provide an acoustic pressure field having a main lobe defined by an angular width thereof; and aligning, simultaneously with said step of applying, said ultrasonic acoustic source such that said main lobe is directed toward said liquid polymeric layer to apply an acoustic pressure of about 190 dB on said liquid polymeric layer, said step of aligning further being carried out such that said main lobe is directed approximately perpendicular to said liquid polymeric layer with said angular width of said main lobe covering said area of the substrate as said liquid polymeric layer is being applied thereto;

whereby said acoustic pressure field reduces said gradient and smoothes said uneven surface of the liquid polymeric layer.

16. A method of coating a substrate comprising the steps of:

applying a liquid polymeric layer to an area of the substrate from a position that is spaced apart from the substrate, wherein said liquid polymeric layer has a thickness and said thickness has a gradient, and said liquid polymeric layer has an uneven surface;

providing an ultrasonic acoustic source approximately aligned with said position;

operating, simultaneously with said step of applying, said ultrasonic acoustic source at a frequency above 20 kHz to provide an acoustic pressure field having a main lobe defined by an angular width thereof; and aligning, simultaneously with said step of applying, said ultrasonic acoustic source such that said main lobe is directed toward said liquid polymeric layer and is approximately perpendicular to said liquid polymeric layer with said angular width of said main lobe covering said area of the substrate as said liquid polymeric layer is being applied thereto;

whereby said acoustic pressure field reduces said gradient and smoothes said uneven surface of the liquid polymeric layer.

17. The method of claim 1 wherein an operator applies the liquid polymeric layer and said acoustic pressure field is p blocked from propagation to said operator applying the liquid polymeric layer.

* * * * *